US007658380B2

(12) United States Patent
Duncan et al.

(10) Patent No.: US 7,658,380 B2
(45) Date of Patent: Feb. 9, 2010

(54) ADAPTIVE AND PREDICTIVE DOCUMENT TRACKING SYSTEM

(75) Inventors: Michael A. Duncan, Charlotte, NC (US); Rodney G. Moon, Charlotte, NC (US); Clair F. Rohe, Huntersville, NC (US)

(73) Assignee: International Business Machines Corporation, Armonk, NY (US)

( * ) Notice: Subject to any disclaimer, the term of this patent is extended or adjusted under 35 U.S.C. 154(b) by 1154 days.

(21) Appl. No.: 11/144,312

(22) Filed: Jun. 3, 2005

(65) Prior Publication Data

US 2005/0225811 A1 Oct. 13, 2005

Related U.S. Application Data

(62) Division of application No. 10/322,912, filed on Dec. 18, 2002, now Pat. No. 6,918,587.

(51) Int. Cl.
*B65H 7/12* (2006.01)

(52) U.S. Cl. ..... 271/265.02; 702/158

(58) Field of Classification Search ..... 271/265.01, 271/265.02; 702/142, 158, 161, 176–179; 347/16

See application file for complete search history.

(56) References Cited

U.S. PATENT DOCUMENTS

| | | | | |
|---|---|---|---|---|
| 3,627,311 | A | 12/1971 | Spinelli | |
| 4,184,674 | A | 1/1980 | Wirz et al. | |
| 4,338,671 | A | 7/1982 | Korytkowski et al. | |
| 4,381,447 | A | 4/1983 | Horvath et al. | |
| 4,511,242 | A | 4/1985 | Ashbee et al. | |
| 4,670,647 | A | 6/1987 | Hubble, III et al. | |
| 4,671,502 | A | 6/1987 | Sherman, III et al. | |
| 4,711,441 | A | 12/1987 | Taylor | |
| 4,761,002 | A | 8/1988 | Reed et al. | |
| 4,875,589 | A | 10/1989 | Lacey et al. | |
| 5,034,771 | A | 7/1991 | Makita | |
| 5,061,946 | A * | 10/1991 | Helmbold et al. | 347/218 |
| 5,289,011 | A | 2/1994 | Wong et al. | |
| 5,298,011 | A | 3/1994 | Krasuski | |
| 5,509,648 | A | 4/1996 | Chen et al. | |
| 5,580,046 | A | 12/1996 | Beaufort et al. | |
| 6,078,678 | A | 6/2000 | Gavrilos | |
| 6,086,064 | A | 7/2000 | Biegelsen et al. | |
| 6,805,425 | B2 * | 10/2004 | Hayashi et al. | 347/16 |
| 6,918,587 | B2 * | 7/2005 | Duncan et al. | 271/260 |

(Continued)

OTHER PUBLICATIONS

Pilkington et al., "Document Tracking System," IBM Technical Disclosure Bulletin, vol. 17, No. 7, Dec. 1974, pp. 1922-1923.

*Primary Examiner*—Kaitlin S Joerger
(74) *Attorney, Agent, or Firm*—Douglas Lashmit Hoffman Warnick LL

(57) ABSTRACT

A system and method for adaptive and predictive analysis of sensor readings to track documents in a document processing system. The system comprises: a plurality of sensors for sensing a document, wherein each sensor includes an associated filtering system for filtering sensor readings, and a performance tracking system for collecting performance data; and a control system that and adjusts filtering characteristics of the filtering system based on the collected performance data. In addition, a correlation system is provided for using data from at least one upstream sensor to interpret an ambiguous downstream sensor signal.

8 Claims, 3 Drawing Sheets

U.S. PATENT DOCUMENTS 7,248,994 B1 * 7/2007 Stolan ..... 702/158
2001/0035603 A1 * 11/2001 Graves et al. ..... 271/265.01
2003/0156150 A1 * 8/2003 Hayashi et al. ..... 347/19

* cited by examiner

ADAPTIVE AND PREDICTIVE DOCUMENT TRACKING SYSTEM

This application is a divisional of application Ser. No. 10/322,912, filed Dec. 18, 2002, now U.S. Pat. No. 6,918,587.

BACKGROUND OF THE INVENTION

1. Technical Field

The present invention relates generally to document sorting and processing, and more particularly relates to an adaptive and predictive document tracking system for high-speed document processing.

2. Related Art

The field of high-speed document processing requires the use of machines and systems capable of moving and processing very large volumes of documents at rates of thousands of documents per minute, while performing multiple and interrelated operations upon each document as it travels through such machinery. Such operations might include, but are not limited to, printing, reading encoded data, recording archival images, etc. One such exemplary system is a check sorting device, commonly used by banks and other financial institutions (e.g., the IBM 3980™ Check Sorter, i.e., "3890").

In a document processor such as the 3890, there are many document sensors located throughout the machine to detect document presence or absence at each location, while the documents are traveling at high speeds through a transport. If a jam develops or documents are mislocated at a particular location, intervention under machine control is necessary to ensure minimal or no damage to customer checks. If machine performance is poor in the tracking function, expensive manual remedies result to clear jams, with the possibility that damage to customer checks is so severe that the information on the check is unrecoverable and lost. This is a very undesirable result, and any improvement in the tracking function to make the system performance more robust and reliable has much value.

A key factor in the performance of document tracking is the behavior and reliability of the document sensor, which is a pneumatic sensor 40 in the 3890 as shown in FIG. 1. The sensor 40 operates with opposing airflow streams 48 (in/out of the page), which in the absence of a document causes an elastic diaphragm 50 to deflect. The diaphragm 50 has on its surface a spiral conductive pattern, which, with the deflection mentioned, makes contact with a conductive plate 52, making a closed contact (a logic zero) for detection of no document. When a document passes between the sensor 48 and one of the air flow streams 48, the pressure within the sensor 48 is reduced to the point where deflection of the diaphragm 50 is insufficient to cause contact between the two conductive surfaces, yielding a logic one indicating the presence of a document. The sensor 40 has ground 54 on one of the conductive surfaces 52 and a pull up resistor 46 to logic supply voltage 44 on the other conductive surface 50, and this latter node then swings between ground 54 and the logic supply voltage 44 as an input signal 42 to subsequent filtering and logic circuitry.

As shown, the pneumatic sensor 40 includes a grounded plate 52 and an arc 50 representing the elastic diaphragm, which deflects depending on pressure of the net air stream through the device represented by the black circle 48. The pneumatic sensor 40 has behavior modes and imperfections that can cause errors in the document tracking function. Some of those are contact bounce, glitching, stuck contacts (open or closed), unusually high resistance when closed, etc.

The filtering and processing of pneumatic sensor data up to now has been done in two stages, the first stage being a very simple first order low pass filter with a time constant of approximately 270 microseconds. This simple filter output is digitized with a Schmitt trigger stage of a comparator with positive feedback, yielding hysterisis thresholds of ⅓ and ⅔ the logic supply voltage. The pneumatic sensor actuate/deactuate delay has been in the few hundred microsecond region. Glitching and contact bounce can occur with pulse widths from a few microseconds to a few hundred microseconds, the larger values being sufficient to get through the filter and cause logic errors, false indications of document presence or absence, etc.

One of the fundamental problems that exist with present day check sorters is the sometimes poor performance of the sensors used for document tracking. Because of the high speeds at which these machines operate, they are often subject to erratic sensor readings. Erratic sensor output leads to loss of accurate document location information in a high-speed transport where documents are running close together. The resulting failures may include document jams, documents that are incorrectly sorted, auto-selects (rejects) due to inadequate processing time for various features located throughout the transport, etc. The net result then involves expensive manual corrective procedures to address the failure.

In order for a sensor to operate properly, it must accurately generate a signal when an edge of a document is detected. However, sensor signals contain glitches, undesired false pulse outputs of significant pulse width, excessive delay of document edge information, and other undesired behavior. Accordingly, failures are primarily caused by lack of clean sensor signal transitions to indicate document edges. To address this, today's sensor handling technology utilizes processing techniques, including a first order filter to clean up the signal. Unfortunately, existing filtering and processing techniques fail to yield acceptable performance for the range of sensor behaviors that are experienced. For the purposes of this disclosure, glitching is defined broadly as any ambiguous signal, e.g., a signal having a strength (voltage) and duration (pulse widths) atypical of a sensor reading.

Very significant engineering effort has been spent on improving the materials and process for manufacture of the sensor itself. In spite of this, the failure rate of new sensors, and the replacement rate of the field install base of sensors leads the sensor to be one of the most expensive items in the field service budget. However, not all sensors that are thought to be defective in the field are found to be defective in later testing.

Accordingly, a need exists for more robust sensor handling systems that can address the erratic behaviors found in many of today's high-speed document machinery.

SUMMARY OF THE INVENTION

The present invention improves the handling and processing of sensor outputs, thereby improving the document tracking function reliability in paper handling and transport applications. In a first aspect, the invention provides a document processing system, comprising: a plurality of sensors for sensing a document, wherein each sensor includes an associated filtering system for filtering sensor readings, and a performance tracking system for collecting performance data; and a control system that and adjusts filtering characteristics of the filtering system based on the collected performance data.

In a second aspect, the invention provides a document processing system, comprising: a plurality of sensors for sensing a document; a document tracking system that collects sensor data from each of the plurality of sensors; and a correlation system for using sensor data from at least one upstream sensor to analyze an ambiguous signal at a downstream sensor.

In a third aspect, the invention provides a method for tracking documents in a document processing system having a plurality of sensors, comprising: collecting sensor readings from each of a plurality of sensors as documents pass each sensor; processing sensor readings using a filter associated with each of the sensors; collecting unfiltered performance data from each of the sensors; and adjusting the filter for at least one sensor based on the collected performance data.

In a fourth embodiment, the invention provides a method for tracking documents in a document processing system having a plurality of sensors, comprising: collecting a sensor reading from each of a plurality of sensors whenever a document passes a sensor; and interpreting an ambiguous signal at a downstream sensor using sensor data from at least one upstream sensor.

BRIEF DESCRIPTION OF THE DRAWINGS

These and other features of this invention will be more readily understood from the following detailed description of the various aspects of the invention taken in conjunction with the accompanying drawings in which.

DETAILED DESCRIPTION OF THE INVENTION

Document Tracking System

Figure 1:
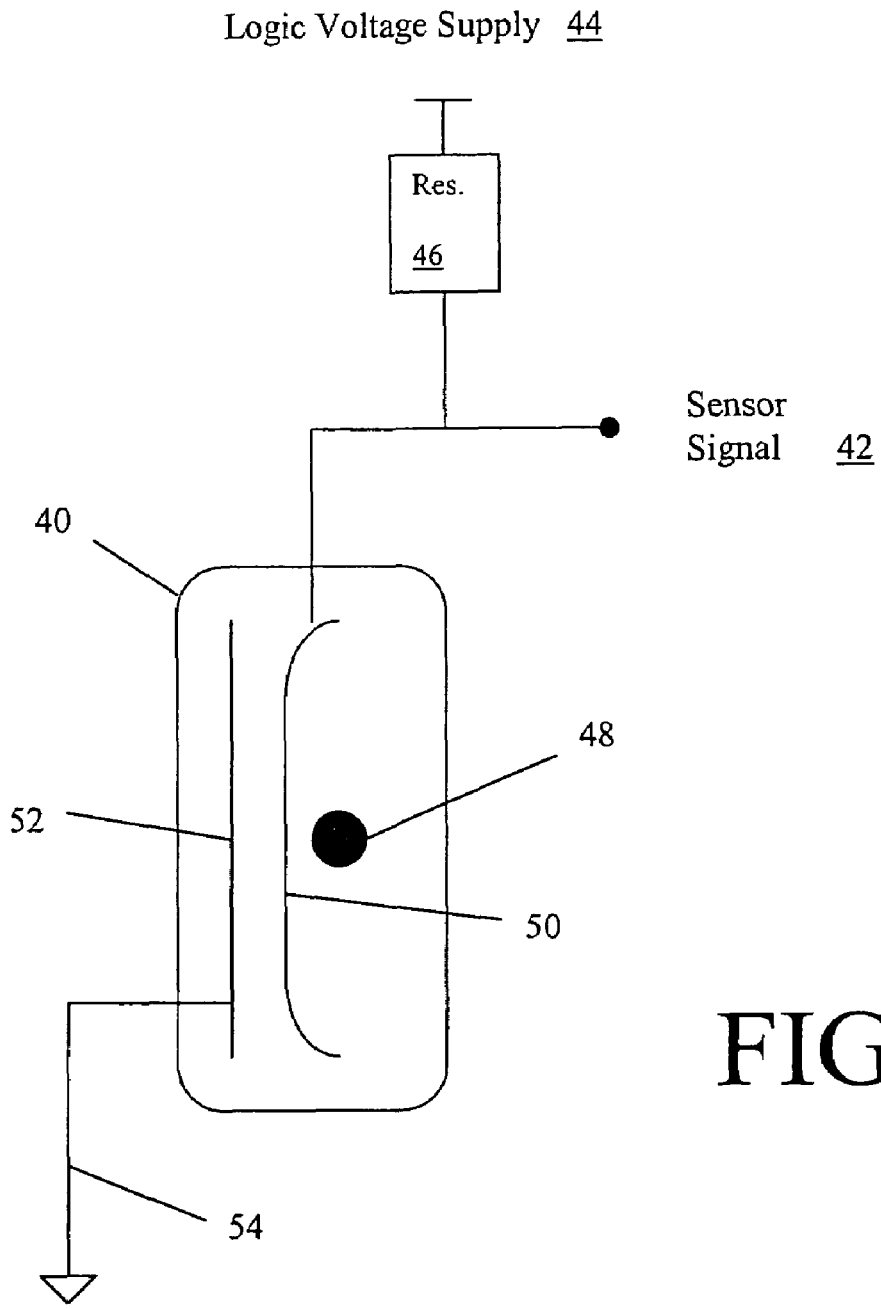
FIG. 1 depicts a pneumatic sensor in accordance with the present invention.
Figure 2:
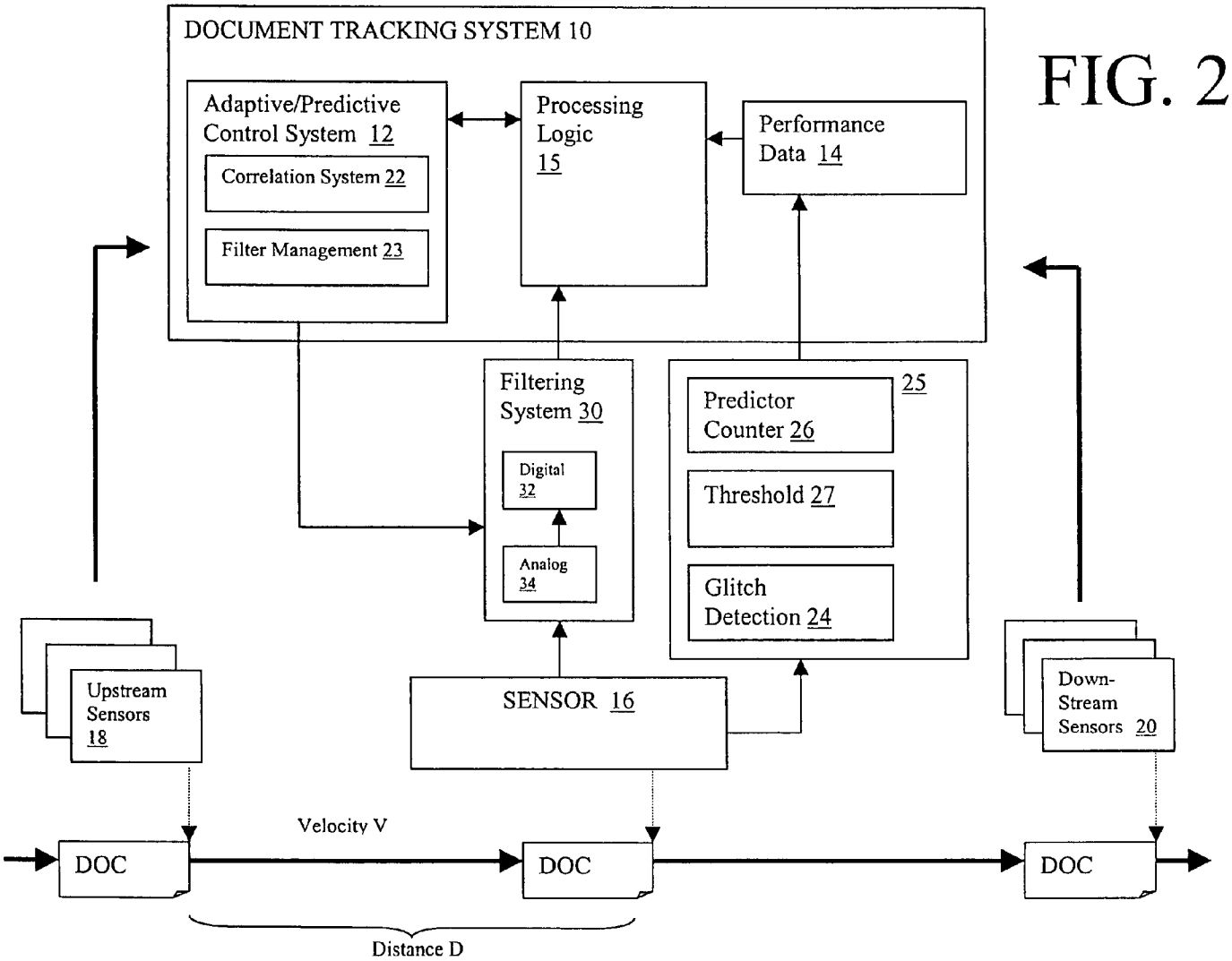
FIG. 2 depicts document processing system in accordance with the present invention.

Referring now to FIG. 2, document tracking system 10 is shown that provides various techniques for improving the handling of imperfect sensor outputs, as well as the improvement of system tracking performance for a document processor. In the exemplary embodiment depicted in FIG. 2, a sensor 16 is provided for sensing a document (DOC) as it travels in a transport past the sensor 16. When the document is sensed, a sensing signal is sent to filtering system 30, which cleans up the signal as necessary, converts it to a logical one or zero, and passes the result to processing logic 15. Processing logic 15 receives the filtered signal and performs any necessary operational and tracking functions. For instance, processing logic may determine that the operation of the document processor should halt if one or more received signals indicate a jamming condition.

In addition to sensor 16, the document processor includes upstream sensors 18 and downstream sensors 20, which similarly process documents along the transport before and after sensor 16, respectively. Each of the upstream sensors 18 and downstream sensors 20 include their own filtering and performance tracking systems, and operate in an analogous manner as sensor 16. Accordingly, it is understood that sensor 16 is but one of many sensors in a document processor that includes the features and capabilities described herein.

Advanced Filtering

As noted above, this embodiment includes several new features for improving performance. The first area involves improvements to the filtering system 30, which includes an analog filter 34 and a digital filter 32. Namely, the present invention proposes more complex analog filtering of the sensor output. With relatively simple and inexpensive active filters, any filter between a 1st order and a 4th order filter low pass filter response can be applied to a pneumatic sensor output. The higher order filters are capable of more severely attenuating unwanted and irrelevant high frequency content in the sensor output without compromising filter delay characteristics as compared to the existing first order filters. In one exemplary embodiment, the analog filter can comprise a $4^{th}$ order Butterworth filter utilizing one or more operational amplifiers, resistors and/or capacitors.

Digital filter 32 may include a Schmitt trigger to digitize the resulting output of the analog filter 34, so that the output of filtering system 30 has a clearly defined logic output, i.e., one or zero. In addition, digital filter 32 can be implemented to further discriminate against particular undesired output behavior of the pneumatic sensor 16. A glitch rejection (or detection) filter can be applied to remove (or flag) glitches up to a certain pulse width threshold, for example. Non-linear processing is easily enabled with digital techniques, e.g. different criteria can be applied for positive versus negative glitch pulse widths.

The filtering system 30 design further includes the overall management of filter response interactions between both the analog 34 and digital filter 32 approaches to ensure the combined transient response of analog plus digital filters meets system delay requirements relative to document edges and critical timing relationships in the transport.

Performance Tracking

In addition, the present invention proposes tracking the performance of each sensor with the use of a performance tracking system 25. In one embodiment, performance tracking system 25 includes a glitch detection system 24 to track the occurrences of sensor glitching. To achieve this, glitch detection system 24 may compare pulse widths of unfiltered signals to a pulse width threshold 27 to determine if a glitch occurred. When a glitch is detected, a digital signal can be sent to predictor counter 26 to maintain a "glitch" count. The count information from each sensor can be maintained by the document tracking system 10 in a performance database 14. The information can be used by processing logic 15, for instance, as a predictor of pneumatic sensors that are trending in a bad direction, and possibly to determine which are candidates to be replaced before they bring a machine performance to unacceptable levels. In addition, as described below, the information can be used to adjust the filtering of a sensor to compensate for known behavior patterns.

Dynamic Control

In order to compensate for the behavior of individual sensors, document tracking system 10 further includes an adaptive/predictive control system 12 to dynamically modify the filter characteristics of the analog filter 34 and/or digital filter 32. Filter characteristics may be altered for any reason, including: to compensate for pneumatic sensor behavior that may be changing with time, e.g., due to aging or deterioration of the sensor; to fit a particular sensor characteristic; to adjust to a particular machine operation; etc. Adaptive/predictive control system ("control system") 12 may include a correlation system 22 that predicts sensor behavior based on the behavior of upstream sensors 18 and downstream sensors 20.

Filter management system 23 adjusts the filter characteristics for each sensor in order to adapt the sensor to both the behavior of the sensor itself (e.g., based on performance data), and the behavior of upstream sensors 18 and downstream sensors 20. Filter changes can be implemented in any known manner. For instance, for digital filters, the coefficients can be readily modified to alter the filter behavior. For analog filters, the capacitance characteristics could be altered to achieve a desired result.

Adaptive processing utilizes the known performance data of a sensor to enhance filter performance. For instance, if it is known that a sensor 16 is prone to glitching, filter management system 23 can modify the filter characteristics of the filtering system 30 to, e.g., more carefully process the sensor signal to avoid mistaking a bad sensor reading for a failure. The modification of filter characteristics using feedback to fit a particular sensor adaptively optimizes the overall handling of sensors. In addition, by dynamically tuning the filters associated with a known problematic sensor, the lifetime of the sensor could be extended.

In addition to adaptive processing, predictive processing to enhance document detection is accomplished with information gathered from the upstream 18 and downstream 20 sensors. As noted above, a poor sensor may generate questionable signals regarding the presence or absence of a document (i.e., does the signal indicate a document or not?). As such, attempting to interpret the signal alone would result in a high level of ambiguity. However, by analyzing the upstream and downstream document indications, the level of ambiguity can be greatly reduced.

For example, by examining the upstream sensors, it can be ascertained that a sensor glitch occurring at a particular time has a high probability of being a document. Knowing the velocity V of the document, and knowing the distance D the document has to travel between sensors in the transport, an exact time of arrival at a downstream sensor can be readily ascertained. Moreover, knowing the length of the document, an expected signal width or duration is also known. The combination of the expected arrival time plus the expected signal duration forms a prediction template. Thus, for instance, if a glitch is sensed at the expected time of arrival and has a duration similar to the prediction template, there is a high degree of likelihood that the glitch is indicative of a sensed document, and not a false reading. Alternatively, if a glitch is sensed outside of an expected time of arrival, the glitch may be indicative of noise and perhaps unacceptable sensor behavior. Accordingly, glitching combined with upstream information, taken in context, can be turned into valid document detection. Conversely, prior art systems typically would reject a document if one sensor in the path gave anything less than a completely independent robust signal output for the document.

In one exemplary implementation, the prediction template could be formed by correlation system 22 and passed to the filtering system 30 of a known problematic sensor 16. Filtering system 30 could then use the prediction template to analyze and bring context to glitching signals. Alternatively, the glitching signal could be passed to correlation system 22 within document tracking system 10, which would utilize the prediction template to bring context to the glitching signal. An example of such a system is depicted in FIG. 3.

Figure 3:
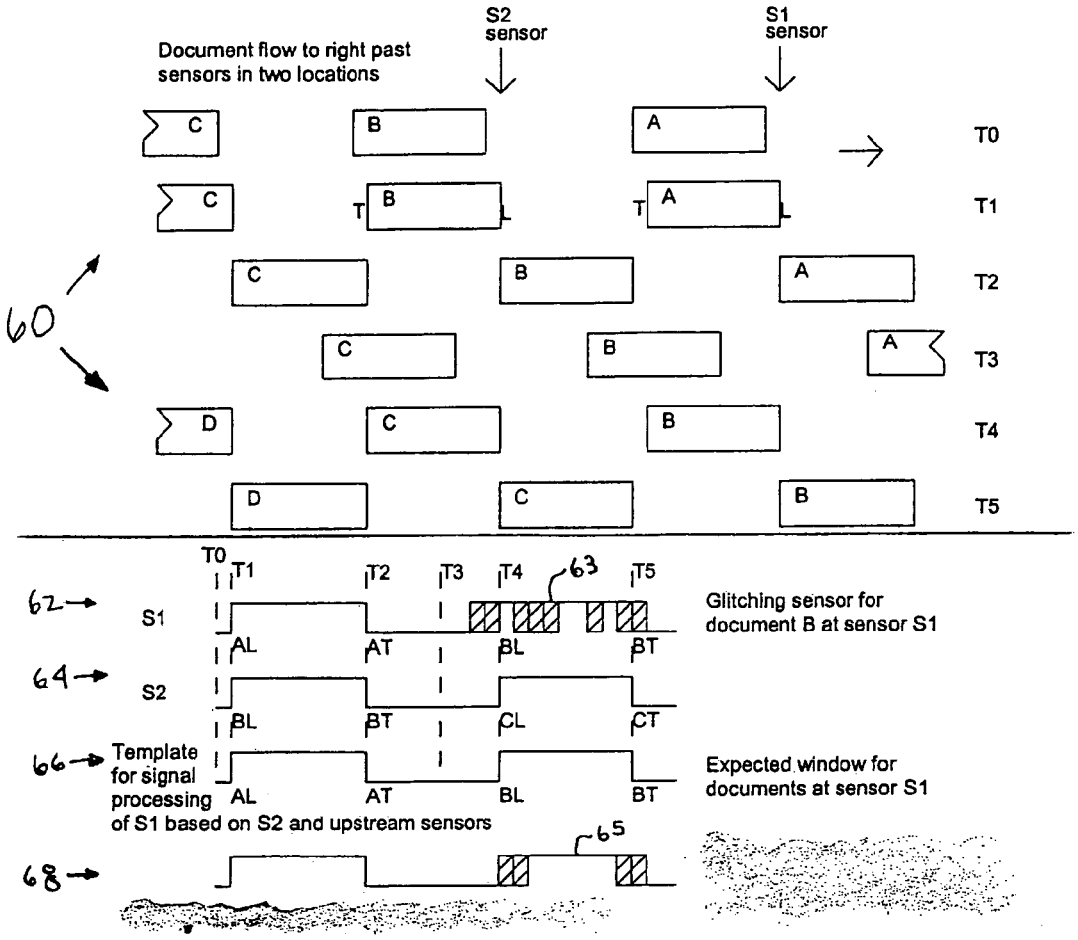
FIG. 3 depicts a timing diagram of a correlation in accordance with the present invention.

FIG. 3 depicts a representation of documents (A, B, C, D) flowing through a transport having an upstream sensor S2, and a downstream sensor S1. The top portion 60 of FIG. 3 depicts the documents at different points in time T0-T5 as they travel along the transport. The bottom portion of the figure depicts timing diagrams including (from top to bottom), sensor readings from S1 62, sensor readings from S2 64, expected sensor readings for S1, i.e., a prediction template 66, and a processed S1 sensor reading 68. Throughout FIG. 3, "T" refers to the trailing edge of the document, and "L" refers to the leading edge.

In this exemplary case, as seen in timing diagram 62, sensor S1 is experiencing a glitching output around the time that document B passes by the sensor. Glitching in this case includes noisy signals 63 shown as diagonal lines occurring before, during and after document B pass by sensor S1. Such a signal pattern 63 may not give a clear indication as to the presence of a document. If the signal pattern 63 is incorrectly interpreted as the absence of a document, a jamming condition could be indicated requiring an unnecessary machine shutdown. Alternatively, if the signal pattern 63 is incorrectly interpreted as document B being present, significant damage could result to the machine.

To bring context to the glitching signal pattern 63, sensor S2 (and/or other sensors) can be examined. As seen in timing diagram 64, sensor S2 is not experiencing glitching. As mentioned above, knowing certain upstream sensor information, such as when document B passed sensor S2, a prediction template 66 for document B at sensor S1 can be established. Using any known correlation technique (e.g., taking a cross product of the glitching signal 63 and the prediction template 66), a processed signal 65 can be created to more accurately indicate the presence or absence of document B.

Thus, the poor output of a sensor can be improved with confidence using correlation (and/or other means) between the expected signal and the actual signal. If sensor S1 had very minimal or no response for document B, then the correlation result would be low or zero, indicating a jam or excessive slip. Conversely, if the output of sensor S1 had a moderate to high response, the correlation result would be reasonably good, and a more accurate representation of document edge locations could be produced than the raw sensor output itself.

Thus, on a macro scale view of a machine with multiple sensors spaced at fairly regular intervals throughout the machine, adaptive and predictive control of the machine transport is enabled by viewing a particular sensor output in the context of what upstream sensors have seen on the document flow, on a document-by-document basis. An "expectation" for a particular document arrival can be forecast and predicted, based on upstream sensors 18. Even if a particular sensor output is not perfect, for example its output contains glitching, but its output is mostly correct in the window of "expected" arrival of a document, then context can be brought to an otherwise ambiguous sensor reading.

Similarly, sensor glitching between documents that might falsely indicate a document can be corrected since: (1) it can be determined (e.g., from downstream sensors) that the previous document has cleared the area, and (2) the following document is not going to slip forward to give such a signal. The following document will only be delayed by slip, not advanced in the transport. Given the transport speed, and following document's length and the gaps seen at previous sensors, there is an "earliest time of arrival" prediction for the following document that is inherently accurate. Any glitching between the previous document's trailing edge, and the "earliest time of arrival" can be ignored.

If a jam occurs for the previous document under the sensor in question, the correlation result would indicate that the expected absence of a document is being contradicted. From upstream sensors 18, the length of the document can be determined and confirmed, and an accurate prediction can be made of when to expect the document at the next sensor. If the resulting correlation using the expectation is low, then there is very high probability that there is indeed a problem in the paper path.

Where two sensors are in parallel, for skew control, numerous improvements can be achieved by placing better discrimination on the two signals that result. For instance, when a problem occurs (e.g., at resync locations in the machine), a determination or prediction can be made regarding which of the two sensors actually failed, rather than replacing both sensors. Correlation and other functions can be performed between the two parallel sensors to improve document detection at either or both parallel sensors. Moreover, correlation with information from upstream sensors (and possibly downstream sensors) can be used to determine which of the two sensors in parallel are giving the most reliable detection of documents, and place more weight on the output of the more reliable sensor for tracking decisions at such locations. The less reliable sensor may still be useable if its behavior is consistent and has predictable behavior, though not perfect. Ultimately, the machine can run on the one reliable sensor for a period of time until the less reliable sensor can be replaced at a planned time. Thus, it is possible to reduce time lost due to machine down situations and the costs of replacing both sensors in the parallel pair of sensors.

Moreover, assuming a properly maintained machine in which skew is an infrequent occurrence, a poor sensor in one of the two parallel sensor locations may falsely indicate skew almost constantly. If no skew is seen upstream or downstream, and the machine is not jamming and other errors are not triggered in the normal processing paths (codeline recognition was good, image analysis looked fine, etc.), then the skew indications from a poor sensor have a high probability of being false. Such indications could be temporarily ignored to allow the machine to keep operating.

It should be understood that the techniques discussed herein could be applied to any type of sensor in any type of paper or document processing system, and could be applied more generally to detection and control of systems in motion or containing elements in motion. Accordingly, these techniques can be applied to improve the reliability and control of any motion control system that uses feedback, e.g., for location, where the feedback is subject to distortion and errors leading to misinformation on what is being controlled. Accordingly, while certain embodiments of the present invention are described with reference to the IBM 3890 Check Sorter ("3890"), it should be understood that the scope of the invention is not limited to any particular document processing system. In addition, it should be understood that while the present embodiment is described with reference to pneumatic sensors, the invention may be applied to a system utilizing other types of sensors.

It is understood that the systems, functions, mechanisms, methods, and modules described herein can be implemented in hardware, software, or a combination of hardware and software. They may be implemented by any type of computer system or other apparatus adapted for carrying out the methods described herein. A typical combination of hardware and software could be a general-purpose computer system with a computer program that, when loaded and executed, controls the computer system such that it carries out the methods described herein. Alternatively, a specific use computer, containing specialized hardware for carrying out one or more of the functional tasks of the invention could be utilized. The present invention can also be embedded in a computer program product, which comprises all the features enabling the implementation of the methods and functions described herein, and which—when loaded in a computer system—is able to carry out these methods and functions. Computer program, software program, program, program product, or software, in the present context mean any expression, in any language, code or notation, of a set of instructions intended to cause a system having an information processing capability to perform a particular function either directly or after either or both of the following: (a) conversion to another language, code or notation; and/or (b) reproduction in a different material form.

The foregoing description of the preferred embodiments of the invention has been presented for purposes of illustration and description. They are not intended to be exhaustive or to limit the invention to the precise form disclosed, and obviously many modifications and variations are possible in light of the above teachings. Such modifications and variations that are apparent to a person skilled in the art are intended to be included within the scope of this invention as defined by the accompanying claims.

The invention claimed is:

1. A document processing system, comprising:

a plurality of sensors for sensing a document;

a document tracking system that collects sensor data from each of the plurality of sensors; and a correlation system for using sensor data from at least one upstream sensor to analyze an ambiguous signal at a downstream sensor.

2. The document processing system of claim 1, wherein the correlation system determines a prediction template for the document at the downstream sensor, wherein the prediction template includes a time of arrival and a duration.

3. The document processing system of claim 2, wherein the correlation system analyzes the ambiguous signal with the prediction template to bring context to the ambiguous signal.

4. The document processing system of claim 2, wherein the correlation system determines the prediction template using a velocity of the document and a known distance of travel for the document.

5. A method for tracking documents in a document processing system having a plurality of sensors, comprising:

collecting a sensor reading from each of a plurality of sensors whenever a document passes a sensor; and interpreting an ambiguous signal at a downstream sensor using sensor data from at least one upstream sensor.

6. The method of claim 5, wherein the interpreting step includes determining a prediction template for the document at the downstream sensor, wherein the prediction template includes a time of arrival and a duration.

7. The method of claim 6, wherein the interpreting step correlates ambiguous signal and the prediction to bring context to the ambiguous signal.

8. The method of claim 6, wherein the prediction template is determined using a velocity of the document and a known distance of travel for the document.

* * * * *

UNITED STATES PATENT AND TRADEMARK OFFICE

CERTIFICATE OF CORRECTION

PATENT NO. : 7,658,380 B2
APPLICATION NO. : 11/144312
DATED : February 9, 2010
INVENTOR(S) : Duncan et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1286 days.

Signed and Sealed this

Thirtieth Day of November, 2010

David J. Kappos

David J. Kappos
*Director of the United States Patent and Trademark Office*